US005285553A

United States Patent [19]

Bahmer et al.

[11] Patent Number: 5,285,553

[45] Date of Patent: Feb. 15, 1994

[54] SLIVER CAN COILER WITH DRAW-IN ROLLERS AND RADIAL FUNNEL MOVEMENT

[76] Inventors: Jakob Bahmer; Kaspar Bahmer, both of Fabrikstrasse 1, D-7924 Steinheim-Söhnstetten, Fed. Rep. of Germany

[21] Appl. No.: 728,470

[22] Filed: Jul. 11, 1991

[30] Foreign Application Priority Data

Jul. 17, 1990 [DE] Fed. Rep. of Germany ..... 4022667

[51] Int. Cl.[5] ..... B65H 54/80

[52] U.S. Cl. ..... 19/159 R

[58] Field of Search ..... 19/150, 157, 159 R; 57/266, 269, 270, 276, 281, 90

[56] References Cited

U.S. PATENT DOCUMENTS

| | | | |
|---|---|---|---|
| 3,638,278 | 2/1972 | Johnels | 19/159 R |
| 3,728,760 | 4/1973 | Johns | 19/159 R |
| 3,736,625 | 6/1973 | Johns | 19/159 R |
| 3,981,055 | 9/1976 | Eakes et al. | 19/159 R |
| 4,324,021 | 4/1982 | Carrera | 19/159 R |
| 4,545,093 | 10/1985 | Jagst | 19/159 R |
| 4,691,413 | 9/1987 | Klüttermann et al. | 19/159 R |
| 4,694,540 | 9/1987 | Rosink | 19/159 R |
| 5,072,492 | 12/1991 | Roccon et al. | 19/159 R |

FOREIGN PATENT DOCUMENTS

| | | | |
|---|---|---|---|
| 0253541 | 12/1911 | Fed. Rep. of Germany | 19/159 R |
| 2907355 | 9/1980 | Fed. Rep. of Germany | 19/159 R |
| 3734425 | 3/1989 | Fed. Rep. of Germany . | |
| 3731885 | 4/1989 | Fed. Rep. of Germany . | |
| 1175844 | 8/1985 | U.S.S.R. | 19/159 R |

*Primary Examiner*—Clifford D. Crowder
*Assistant Examiner*—Ismael Izaguirre
*Attorney, Agent, or Firm*—Jenner & Block

[57] ABSTRACT

An apparatus for depositing sliver in a can. The sliver is introduced from above and is deposited continuously in the can in layers one above the other from bottom to top. The sliver is guided by a guiding device. The device includes rollers contained by an annular device. At least one of the rollers has a conical shape. The rollers make contact with and draw the sliver into the can. The guiding device includes a funnel which is movable in a radial direction such that the sliver is deposited in successive spiral paths in the can. A counterbalancing device is provided so as to counteract the movement of the funnel. The sliver is guided such that the spiral path runs alternately from an outer radial position to an inner radial position approximately adjacent the can center and from the inner radial position to the outer radial position adjacent an inner wall of the can.

17 Claims, 4 Drawing Sheets

8
7
6
A
22
5
3
4
26
24
2
25
21

SLIVER CAN COILER WITH DRAW-IN ROLLERS AND RADIAL FUNNEL MOVEMENT

BACKGROUND OF THE INVENTION

1. Field of the Invention

The invention relates to a process and an apparatus for depositing sliver in containers, and in particular where the sliver is introduced from above and is deposited in a can continuously in layers one above the other from the bottom to the top.

2. Description of the Related Art

In the case of spinning preparation machines, particularly in high-performance drawing machines or carders, sliver is deposited in a cylindrical container such as a can. Typically there is a can block with a rotary plate which has a sliver channel through which the sliver runs from top to bottom. A process and an apparatus of this type is described for example in DE-OS 37 31 885.

DE-PS 37 34 425 also describes a can block having a can in which the sliver is deposited. Here, the sliver is deposited in the form of circles arranged against one another in the can and laid endlessly and horizontally to run peripherally from the can edge to the can center. In this case, two types of circular deposition are used, namely a type of deposition which is larger than the can center, i.e., which goes beyond the can center, and a deposition which is smaller than to the can center.

A major disadvantage with this process is that during the deposition a number of crossings of the layers are unavoidable. This is particularly true in the region of the can center. The result is the formation of a tower and crushing of the sliver, which presents problems in the technical aspects of spinning.

Attempts have been made to alleviate the disadvantages that a free space is left in the center of the can and that the circular depositions are ranged against one another loosely. In these attempts, however, another disadvantage results from the fact that a considerable filling quantity is lost and a smaller amount of sliver is deposited in the can, because of the large unused free space in the can center. Furthermore, another disadvantage is that with this type of deposition, loops hindering the spinning process are formed if the sliver is subsequently drawn off from the can at high speed for the next working step in a manufacturing process.

SUMMARY OF THE INVENTION

It is thus an object of the invention to provide a process and an apparatus which does not have the disadvantages described above, and in particular one in which there is better utilization of space and fewer instances of crushing of the sliver.

In accordance with the invention, this object is achieved in that the sliver is guided by guide means such that it is deposited in each case in spiral paths in the can, the path being guided such that the spiral path runs alternately from the outside to the inside to at least approximately as far as the region of the can center and from the inside to the outside as far as the inner wall of the can.

The type of winding according to the invention allows the space in the can to be utilized to a considerably greater extent, since deposition can take place from the can center or almost to the can center. It is also a result of the alternate spiral deposition from the outside to the inside and from the inside to the outside that there is only a single crossing per layer, whereas in the case of known processes a number of crossings are present for each layer.

In order to achieve this process of deposition, it is merely necessary to provide for a spiral deposition of the sliver using a guide means, it being necessary to ensure synchronized movement between the sliver infeed rate and movement of the spiral deposition.

An apparatus according to the invention for carrying out the process includes: a can block, a sliver infeed apparatus, a sliver funnel and sliver draw-in rollers which are arranged below the sliver funnel and above the can and includes the provision that at least one of the two sliver draw-in rollers is constructed as a conical roller where the diameter is directed towards the longitudinal axis of the can. Also, the sliver funnel may be adjusted by an adjustment apparatus in the radial direction from the region of the largest internal diameter of the can as far as the region of the longitudinal axis of the can.

In the apparatus according to the invention, the sliver is moved by the sliver funnel, simultaneously with the peripheral movement and outwards. The conical shape of the conical roller here results in uniform deposition, with the conical taper being designed in dependence on the selected speeds, such that in the outer region, because of the longer travel of the sliver, there is a larger diameter and in the inner region, because of the shorter travel of the sliver, there is a correspondingly smaller diameter. The angle of taper of the cone and the infeed rate are matched to the peripheral speed such that the quantity delivered is always the same and thus there is uniform spiral winding without intermediate spaces. In other words, this means that rotation of the rotary plate or spinning can should be at the same rate as the taking-off at the cone.

For optimum utilization, the conical roller should have a length corresponding at least approximately to the internal radius of the can.

In this manner, the entire capacity of the can is filled uniformly.

A particularly simple structure results if the conical roller revolve on a fixed ring about the longitudinal axis of the can.

Also, at least two further conical rollers can be provided which, together with the conical roller forming a sliver draw-in roller, are arranged in a rotating rotary plate which revolves coaxially with respect to the longitudinal axis of the can above the latter.

In this manner, the rotating part is guided on the fixed ring and approximate support results.

For adjusting the apparatus, a great variety of mechanisms can be used. The only essential feature is that a linear movement moving to and from in the radial direction is imposed on the sliver funnel.

One embodiment may include the second sliver draw-in roller also being constructed as a conical counter-roller, where the sliver funnel with the adjustment apparatus is located above the gap between the two conical rollers.

In this case, the sliver is guided from the sliver funnel through the gap between the two conical rollers, the adjustment apparatus ensuring that the sliver is moved in the gap between the two conical rollers radially from the inside to the outside and from the outside to the inside, while revolving simultaneously.

Another embodiment consists in the second sliver draw-in roller being a press roller which, together with the adjustment apparatus, may be displaced in the radial direction along the cone envelope of the conical roller.

For a frictional wheel drive of the conical rollers, which during revolution around the central axis of the can roll on the fixed ring, the rollers may be provided with friction surfaces.

The rotary bearing between the fixed ring and the rotating rotary plate may include a ball bearing, a sliding bearing, rollers which are arranged distributed over the periphery and are mounted in the rotating rotary plate in the fixed ring, or by a magnetic or air bearing.

Advantageously, the drive unit for the rotating rotary plate will be designed to be speed-regulable.

As the drive unit, for example an electric motor can be used, with or without eddy current coupling, along with belt drive or a toothed wheel to engage the electric motor with the rotating rotary plate.

It is also possible in an advantageous manner to use a ring motor, the stator being located in the fixed ring and the rotor being located in the rotating rotary plate.

To prevent imbalances, and thus to produce more stable running, it may be provided that in mirror symmetry with the adjustment apparatus with respect to the longitudinal axis there is arranged a counter-apparatus, operating in mirror symmetry therewith, with balancing weights.

An advantageous further development of the invention may consist in the conical rollers being covered by a conveyor belt which rotates synchronously with the delivery speed of the sliver about the longitudinal axis of the can.

The conveyor belt replaces the base of the rotary plate and covers the envelope surfaces of the cones. Since the conveyor belt rotates synchronously with the delivery speed, there is consequently no friction with respect to the sliver deposited. This is particularly advantageous if for example the user fails to change the can promptly, since in such a case friction between the deposited sliver in the can and the rotating rotary plat would result.

Example embodiments of the invention, from which further advantages according to the invention emerge, are described in principle below, with reference to the drawing, in which:

DESCRIPTION OF THE PREFERRED EMBODIMENTS

Figure 1:
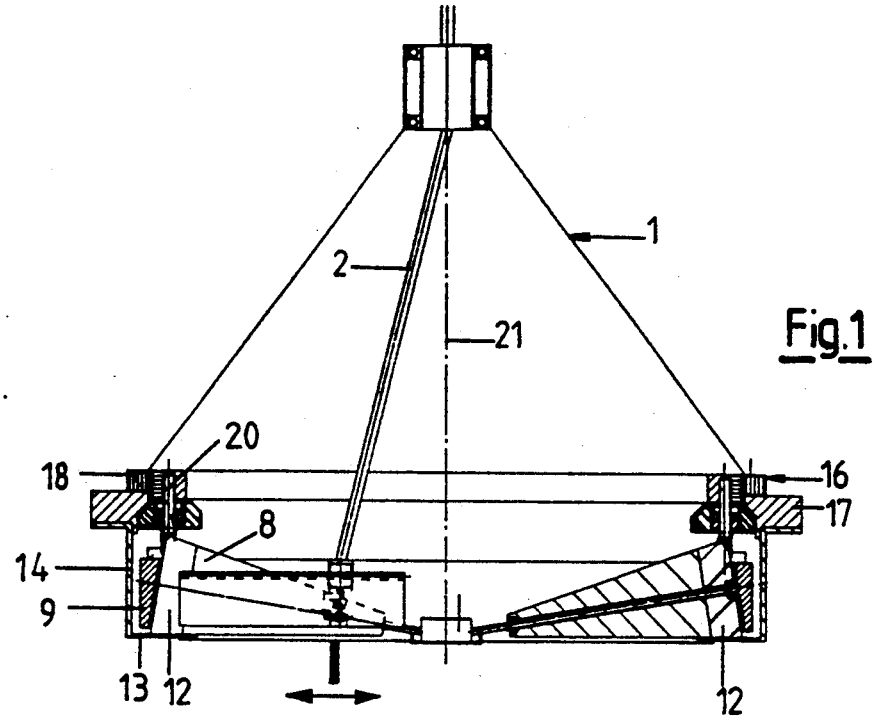
FIG. 1 is a vertical section through the apparatus according to the invention.

The apparatus according to the invention is basically of known construction, and for this reason only those parts essential to the invention will be discussed in detail below.

A rotary mechanism 1, also called a can block, is arranged above a can. Sliver 2 is introduced into the can block from above by sliver infeed rollers (not shown). The sliver 2 is guided through a sliver funnel 23 which is connected, directly or indirectly by the sliver guided through, to an adjustment apparatus 3.

The adjustment apparatus 3 may be constructed in the manner of a connecting link, with a slide 5 being pushed to and from in the radial direction on a guide 4. The slide 5 may for example be displaced by way of belts 6 and 7, not shown in detail (see FIG. 3). The belts 6 and 7 may in this case be guided endlessly via deflection rollers and be moved by drive means and reversing switches or limit stops, not shown in detail, such that the slide 5 may be displaced in the direction of the arrow A.

Figure 2:
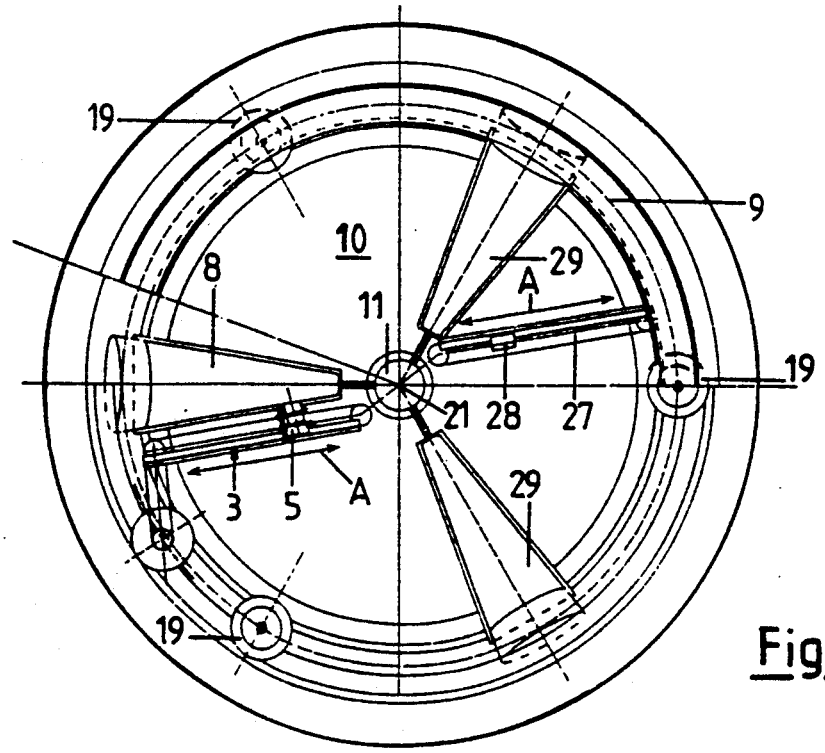
FIG. 2 is a plan view of the apparatus of FIG. 1.
Figures 3, 4:
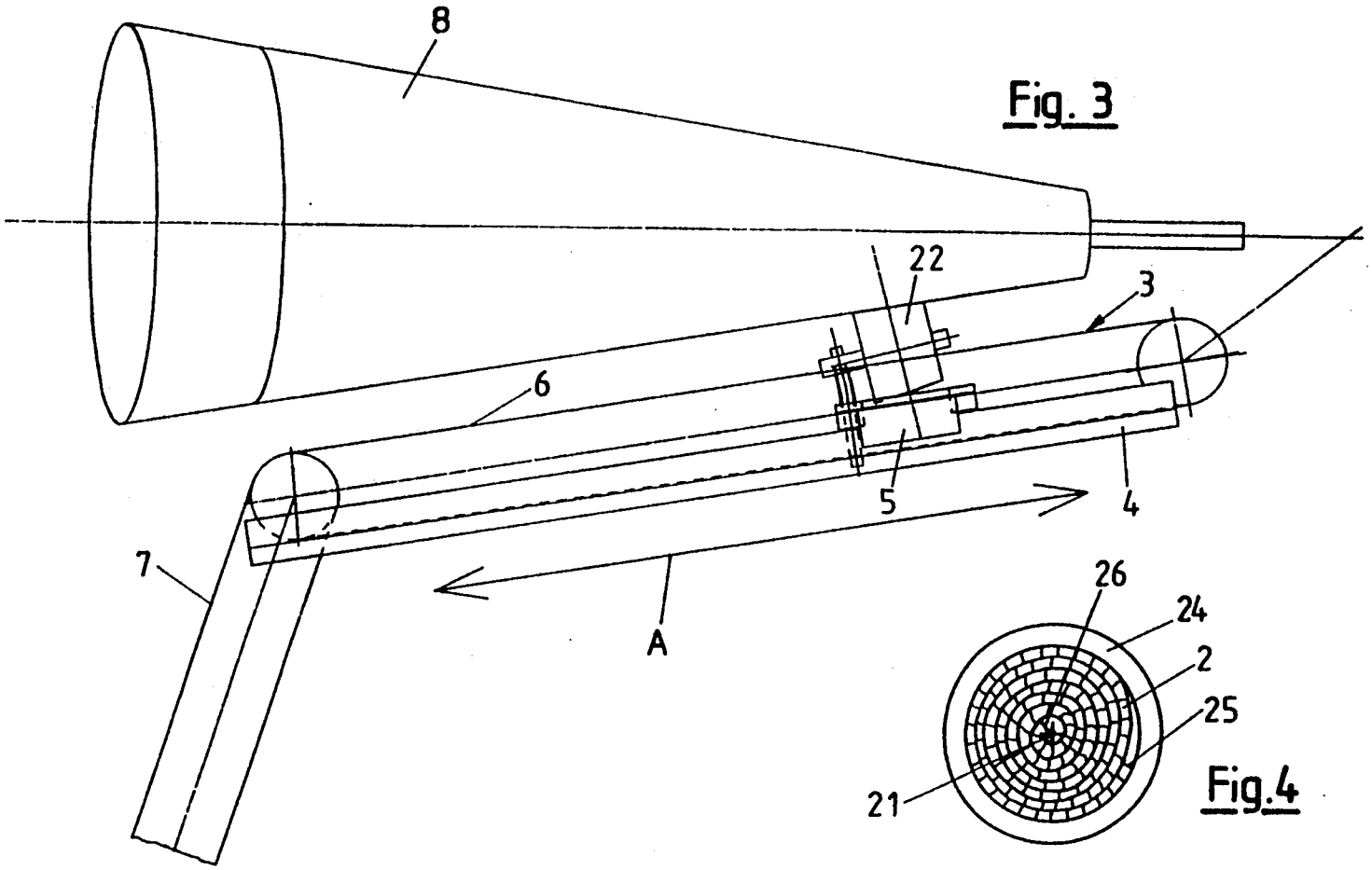
FIG. 3 is an enlarged illustration of a conical roller used as a sliver draw-in roller, having an adjustment apparatus for a sliver funnel.
FIG. 4 is an illustration in plan view of the spiral deposition of the sliver as provided by the apparatus of FIG. 1.

As can be seen from FIGS. 1 and 2 and from the enlarged illustration in FIG. 3, there is arranged in the rotary plate 1 a conical roller 8 which forms a sliver draw-in roller. The conical roller is mounted in a rotating support or rotary plate 9 which is constructed in the manner of a ring and has a raised base 10 and a hub 11. On the outside, the conical roller 8 is mounted in part of the ring-shaped peripheral wall of the rotary plate 9, and on the inside it is mounted in the hub 11. In this case, the axis of the cone is set slightly oblique with respect to the horizontal, in such a way that the cone envelope runs horizontally on the underside and projects through a cutout in the base 10.

In the region of the larger diameter of the conical roller 8, there is on the end side a friction surface 12 as a direct elongation of the conical roller 8. By means of the friction surface 12, the conical roller 8 can roll on a horizontal section 13 of the fixed or stationary ring 14. In the upper region, the rotary plate 9 is mounted at its outer periphery in the ring 14 and is rotatable with respect thereto. As the drive for the rotary plate 9 around the longitudinal axis 21 of the can (see FIG. 4) there serves, in accordance with the example embodiment of FIGS. 1 and 2, a ring motor 16 whereof the stator 17 is arranged on the ring 14, while the rotor 18 forms parts of the rotating rotary plate 9.

As the rotary bearing between the rotary plate 9 and the ring 14 thee are three rollers 19 that are distributed over the periphery and which are mounted via vertical spindles 20 in the rotary plate 9 or ring 14.

As can be seen from FIG. 1 and in particular from FIG. 3, rotatably mounted on the slide 5 is a press roller 22 having an approximately horizontal axis. The press roller 22 is pressed resiliently against the cone envelope of the conical roller 8 by means of its outside surface. The sliver funnel 23 is also connected to the slide 5, in a manner not shown in detail.

After the sliver 6 has passed through the sliver funnel 23, it is drawn in between the conical roller 8 and the press roller 22. Since the press roller 22 moves in the radial direction with respect to the slide 5, the sliver is deposited, with appropriate coordination of the rotational speed of the rotary plate 9 about the longitudinal axis 21 and the rolling movement of the conical roller 8, corresponding to the taper of the cone on the section 13 of the stationary ring 14, a spiral deposition of the sliver 2 in the interior of the cone 24 results (see FIG. 4). Starting for example from an external deposition point 25 in the region of the inner peripheral wall of the can 24, where the slide 5 is located on the outside in the region of the largest diameter of the conical roller 8 (on the left in the drawing of FIG. 3), the sliver 2 is deposited in a first layer in the can 24 in a spiral with a decreasing radius during the radially inwardly directed displacement of the slide 5. In the region of the longitudinal axis 21, i.e., when the slide 5 with the press roller 2 and the sliver 2 guided between the press roller 2 and the conical roller 8 comes up against the inner end of the conical roller 8 in the region of the smaller diameter, the direction of movement of the slide 5 is reversed and the sliver 2 continues to be wound in a spiral in a second layer from the inside to the outside. As can be seen, the sliver only crosses over at a single point in the inner region during this operation. The inner point of reversal is designated "26" in FIG. 4.

Of course, within the scope of the invention it is also possible for the can 24 to rotate, as is generally known, instead of or in addition to rotating the plate 1.

In mirror symmetry with the guide 4 having the slide 5 relative to the longitudinal axis 21, a counter-balancing mechanism 27 with balancing weights 28 is arranged in or on the rotary plate 9. The balancing weights 28 of the counter-balance 27 are disposed, in the same way as the slide 5 in the manner of a connecting link, to prevent imbalance in the apparatus.

As can furthermore be seen from FIGS. 1 and 2, with respect to the conical roller 8 and at the same spacing therefrom there are mounted two further conical rollers 29 in the rotary plate 9 so that a corresponding guidance and mounting arrangement results. The two conical rollers 29 also project through cutouts in the base 10 and roll on the section 13 of the ring 14.

Figure 5:
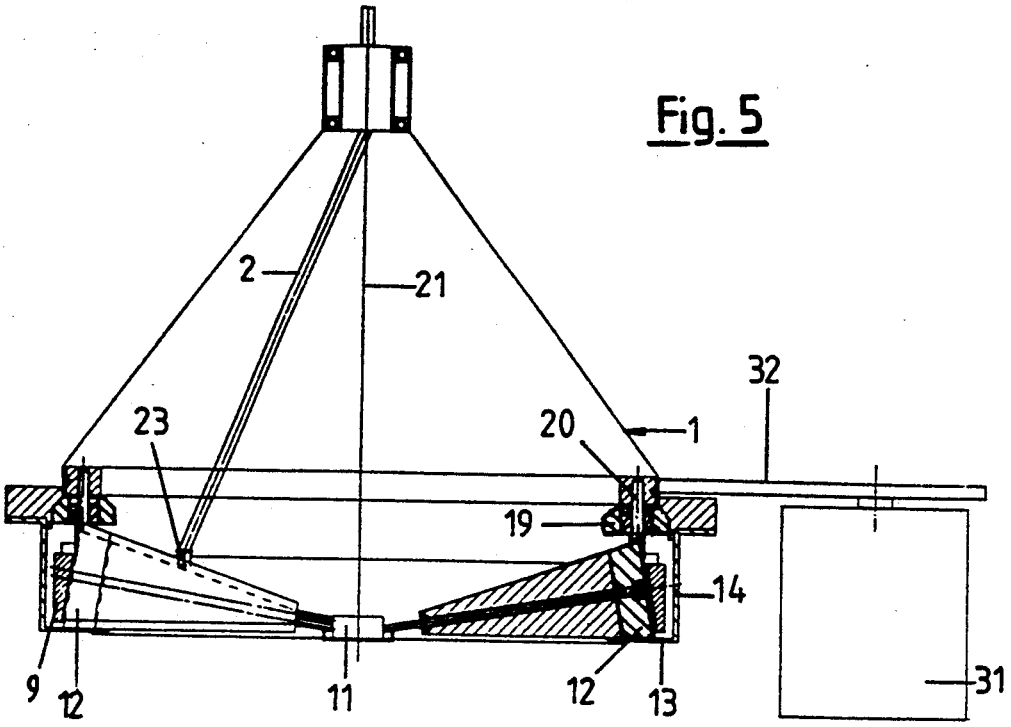
FIG. 5 is a sectioned view, similar to that of FIG. 1, of another embodiment of the invention.
Figure 6:
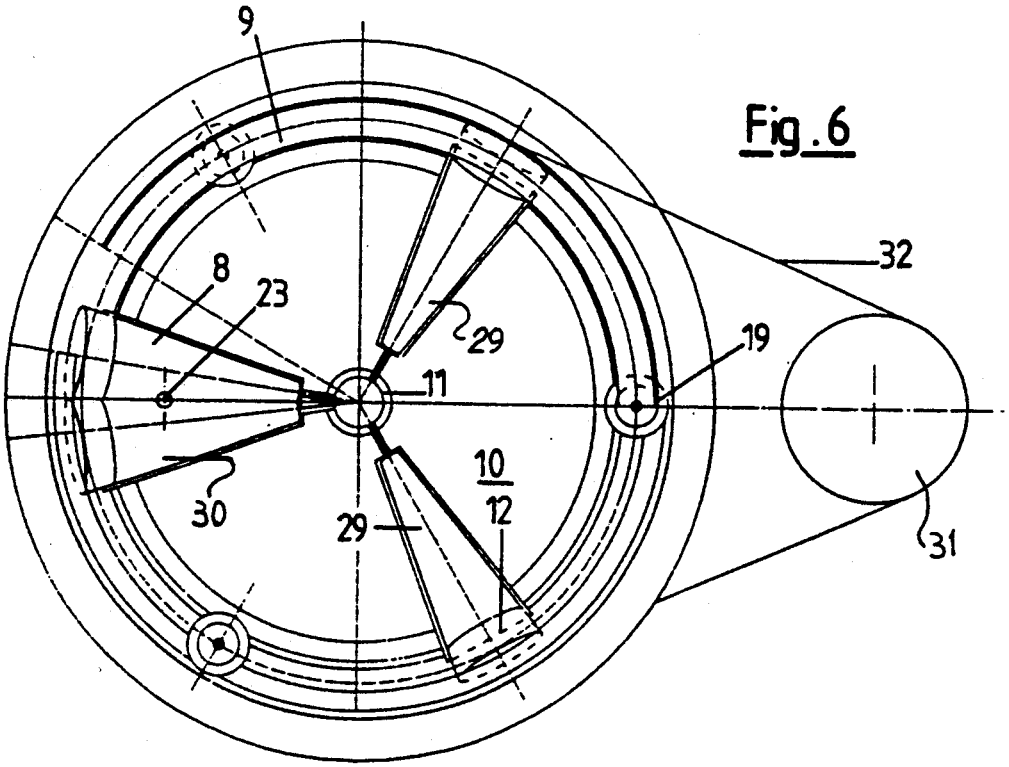
FIG. 6 is a plan view of the apparatus of FIG. 5.

In FIGS. 5 and 6, there is illustrated another embodiment where the construction corresponds generally to the embodiment of FIGS. 1 and 2. For this reason, the same reference numerals have been used for the same parts.

The essential difference from the embodiment according to FIGS. 1 and 2 consists in the fact that instead of a press roller 22 there is provided a conical counter-roller 30 cooperating with the conical roller 8 which is also mounted in the same manner in the rotary plate 9. In this case, the sliver 2 is guided through a gap between the two conical rollers. In this embodiment, the sliver funnel 23 is connected only to the adjustment apparatus 3, which brings about linear movement in the radial direction, in a manner not shown in detail.

Instead of a ring motor 16, in this embodiment the rotary plate is driven by a speed-regulable electric motor 31 and a belt drive 32 or electric motor with eddy current coupling.

Instead of a belt drive 32, a toothed wheel gearing or another drive may of course also be used.

Instead of mounting the rotary plate 9 in the ring 14 via rollers 29, a ball or sliding bearing may be provided between the two parts.

Instead of a fixed base 10, which brings about relative movement between the deposited sliver 2 and the rotary plate 1 or the base 10 when the can 24 has been filled completely, it is also possible to provide a conveyor belt (not shown) which rotates synchronously with the delivery speed of the sliver 2 about the longitudinal axis 21 of the can 24.

Instead of the slide 5 being displaced in the manner of connecting link by the belts 6 and 7, other adjustment apparatus may be used within the scope of the invention, such as a toothed rack or a spindle. The adjustment apparatus may be reversed for example by using cams.

Figure 7:
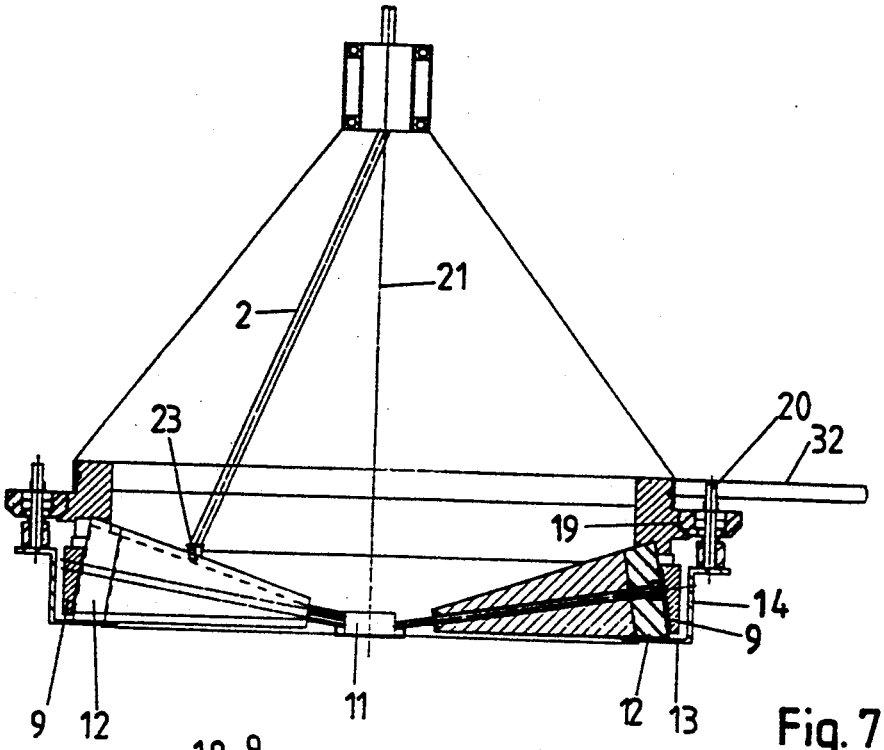
FIG. 7 is a sectioned view, similar to that of FIG. 5, with the rotary plate mounted differently.
Figure 8:
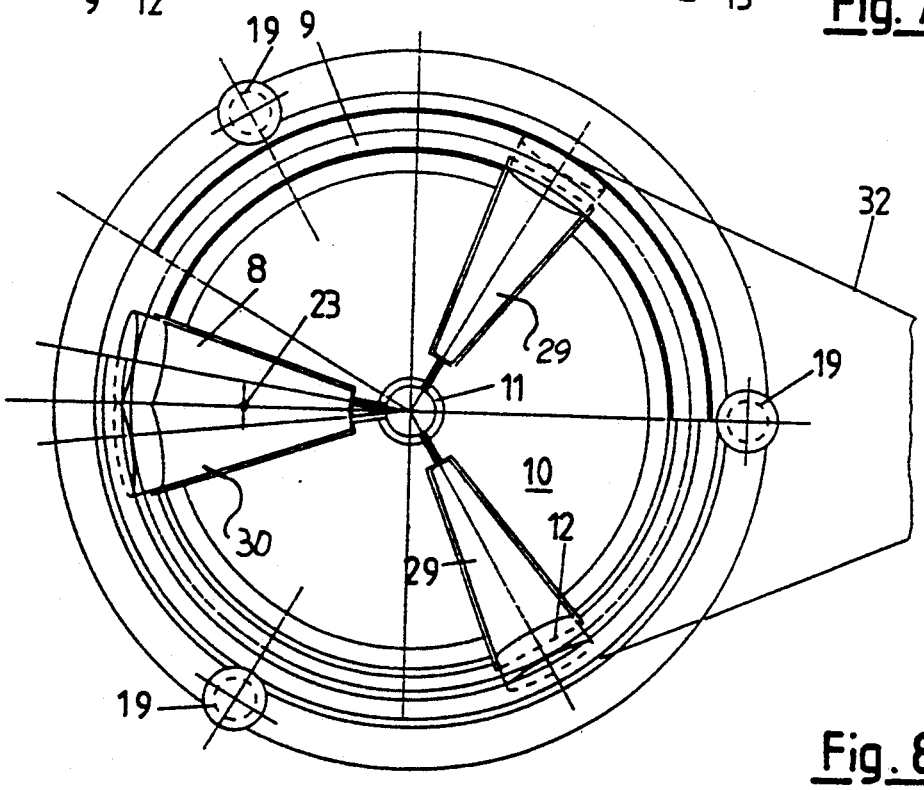
FIG. 8 is a plan view of the apparatus of FIG. 7.

FIGS. 7 and 8 illustrate two further embodiments of the invention, the only difference with FIGS. 5 and 6 consists in the fact that the rotary plate 9 is mounted differently with respect to the fixed ring 14. As can be seen, the rollers 19 are secured rotatably on the fixed ring 14 by way of a shaft, and the relative movement takes place between the rotary plate 9 and the rollers 19.

We claim:

1. An apparatus for depositing sliver in a can having a central longitudinal axis, the apparatus comprising;

a plurality of sliver draw-in rollers for drawing the sliver into the can through a funnel, at least one of said rollers having a conical configuration having a central longitudinal axis extending radially to the axis of the can and having a diameter decreasing in a direction towards the longitudinal axis of the can, said sliver draw-in rollers contacting the sliver to draw the sliver into the can;

moving means for moving said funnel in a radial direction to the longitudinal axis of said can whereby the sliver is deposited in a spiral path in said can.

2. The apparatus of claim 1 wherein a second of said rollers has a conical configuration, is adjacent said at least one sliver draw-in roller having a conical configuration, and cooperates with said at least one roller having a conical configuration to draw said sliver through said funnel, and said funnel and said moving means being located above said rollers.

3. The apparatus of claim 1 wherein one of said rollers is a press roller which, together with said moving means, is displaced in said radial direction.

4. The apparatus of claim 1 wherein said moving means comprises an elongated adjustment apparatus having a longitudinal axis substantially parallel said longitudinal axis of said at least one conical sliver draw-in roller, said adjustment apparatus further comprising a slide and a guide, said slide being moveable on said guide in a direction substantially parallel to said longitudinal axis of said adjustment apparatus.

5. An apparatus for depositing sliver in a can having a central longitudinal axis, the apparatus comprising:

a funnel for guiding the sliver into the can;

an annular member coaxial with the axis of the can;

a plurality of conical rollers extending radially of said axis of the can, each of said rollers having a length corresponding to the radius of said annular member and each having diameters decreasing in a direction towards the axis of the can;

a plurality of sliver draw-in rollers for drawing the sliver into the can through the funnel, at least one of said rollers having a conical configuration having a central longitudinal axis extending radially to the axis of the can and having a diameter decreasing in a direction towards the longitudinal axis of the can, said sliver draw-in rollers contacting the sliver to draw the sliver into the can; and moving means for moving said funnel such that the sliver is deposited in a spiral path in the can.

6. The apparatus as claimed in claim 5 wherein said rollers are located in a second annular member coaxial with said annular member, said second annular member being movable relative to said annular member on the axis of the can and the apparatus including a plurality of bearings for supporting said second annular member relative to said annular member and the apparatus further including speed-regulable drive means for moving said second annular member relative to said annular member.

7. The apparatus is claimed in claim 6 wherein said drive means includes an electric ring motor having an annular stator and a rotor, said annular stator being located in said annular member.

8. The apparatus of claim 5 wherein a second of said sliver draw-in rollers has a conical configuration, is adjacent said at least one sliver draw-in roller having a conical configuration, and cooperates with said at lest one roller having a conical configuration to draw said sliver through said funnel, and said funnel and said moving means being located above said rollers.

9. The apparatus of claim 5 wherein one of said sliver draw-in rollers is a press roller which, together with said moving means, is displaced in said radial direction.

10. The apparatus in claim 5 wherein said moving means comprises an elongated adjustment apparatus having a longitudinal axis substantially parallel to said longitudinal axis of said at least one conical sliver draw-in roller, said adjustment apparatus further comprising a slide and a guide, said slide being moveable on said guide in a direction substantially parallel to said longitudinal axis of said adjustment apparatus.

11. An apparatus for depositing sliver in a can having a central longitudinal axis, said apparatus comprising:

a funnel for guiding the sliver into the can;

a plurality of conical rollers extending radially to the axis of the can and each having diameters decreasing in a direction towards the axis of the can;

a plurality of sliver draw-in rollers for drawing the sliver into the can through the funnel, at least one of said rollers having a conical configuration having a central longitudinal axis extending radially to the axis of the can had having a diameter decreasing in a direction towards the longitudinal axis of the can, said sliver draw-in rollers contacting the sliver to draw the sliver into the can;

moving means for moving said funnel such that the sliver is deposited in a spiral path in the can; and means for counter balancing said moving means.

12. The apparatus as claimed in claim 11 including a conveyor belt cooperating with said rollers for effecting rotation of said rollers, synchronously with the speed of the sliver, about the longitudinal axis of the can.

13. The apparatus of claim 11 wherein a second of said sliver draw-in rollers has a conical configuration, is adjacent said at least one sliver draw-in roller having a conical configuration, and cooperates with said at least one roller having a conical configuration to draw said sliver through said funnel, and said funnel and said moving means being located above said rollers.

14. The apparatus of claim 11 wherein one of said sliver draw-in rollers is a press roller which, together with said moving means, is displaced in said radial direction.

15. The apparatus in claim 11 wherein said moving means comprises an elongated adjustment apparatus having a longitudinal axis substantially parallel to said longitudinal axis of said at least one conical sliver draw-in roller, said adjustment apparatus further comprising a slide and a guide, said slide being moveable on said guide in a direction substantially parallel to said longitudinal axis of said adjustment apparatus.

16. An apparatus for depositing sliver in a can having a central longitudinal axis, the apparatus comprising;

a plurality of sliver draw-in roller for drawing the sliver into the can through the funnel, at least one of said rollers having a conical configuration having a central longitudinal axis extending radially to the axis of the can and having a diameter decreasing in a direction towards the longitudinal axis of the can;

moving means for moving said funnel in a radial direction to the longitudinal axis of said can whereby the sliver is deposited in a spiral path in said can; and a second of said sliver draw-in rollers is a press roller which, together with said moving means, is displaced in said radial direction.

17. The apparatus of claim 16 wherein said moving means comprises an elongated adjustment apparatus having a longitudinal axis substantially parallel to said longitudinal axis of said at least one conical sliver draw-in roller, said adjustment apparatus further comprising a slide and a guide, said slide being moveable on said guide in a direction substantially parallel to said longitudinal axis of said adjustment apparatus.

* * * * *

UNITED STATES PATENT AND TRADEMARK OFFICE

CERTIFICATE OF CORRECTION

PATENT NO. : 5,285,553

DATED : February 15, 1994

INVENTOR(S) : Jakob Bahmer and Kaspar Bahmer

It is certified that error appears in the above-identified patent and that said Letters Patent is hereby corrected as shown below:

Column 4, line 44, delete "thee" and insert --there--

Column 7, line 6, delete "lest" and insert --least--

Column 7, line 31, delete "had" and insert --and--

Column 8, line 21, delete "roller" and insert --rollers--

Signed and Sealed this

Twenty-first Day of June, 1994

Bruce Lehman

*Attest:*

BRUCE LEHMAN

*Attesting Officer*

*Commissioner of Patents and Trademarks*